US005117524A

United States Patent [19]

Chang

[11] Patent Number: 5,117,524

[45] Date of Patent: Jun. 2, 1992

[54] DEVICE FOR CUTTING A TAPE OF A ROLL OF TAPES AND OPENING AN ENVELOPE

[75] Inventor: Key Yia Chang, Kwangmyong, Rep. of Korea

[73] Assignee: Hanseung Company, Ltd., Kyunggi-Do, Rep. of Korea

[21] Appl. No.: 760,912

[22] Filed: Sep. 17, 1991

[51] Int. Cl.[5] ..... B25F 1/00

[52] U.S. Cl. ..... 7/160; 30/123; 30/294; 30/DIG. 3; 83/912

[58] Field of Search ..... 7/158, 160, 170; 30/DIG. 3, 123, 278, 280, 286, 289, 294; 83/912

[56] References Cited

U.S. PATENT DOCUMENTS 673,375 5/1901 Bayha ..... 30/DIG. 3
2,815,572 12/1957 Deicken ..... 30/DIG. 3
4,711,031 12/1987 Annello ..... 30/DIG. 3

*Primary Examiner*—Roscoe V. Parker
*Attorney, Agent, or Firm*—Birch, Stewart, Kolasch & Birch

[57] ABSTRACT

An easily assembled and disassembled device for cutting a tape from a roll of tape and opening an envelope which includes a push button member having a cutting blade and a push button, a tape guiding member supported on an envelope inserting member and a roll tape supporting member assembled therewith and the push button member, whereby when push button is downwardly pushed, the tape disposed on the tape guiding member or an envelope inserted into the envelope inserting member is easily and straightly cut by the cutting blade of the push button member.

3 Claims, 3 Drawing Sheets

DEVICE FOR CUTTING A TAPE OF A ROLL OF TAPES AND OPENING AN ENVELOPE

BACKGROUND OF THE INVENTION

1. Field of the Invention

The present invention relates to a device for cutting a roll of tape and opening an envelope and more particularly, to an improved cutter for an adhesive tape and an envelope especially useful for a roll of tape and a letter envelope.

2. Description of the Prior Art

Previously, several types of cutters for adhesive tapes and envelope openers have been separately developed in the art. Practically, every office worker is provided with numerous desk implements with which to carry out one's duties. These generally include memo pads, envelopes, an envelope opener, a roll of tape, a tape dispenser, etc. However, these cutter and envelope openers suffer from a number of difficulties since separate tape cutters and envelope openers require separate purchases which may be expensive and a large amount of space in a brief case or on the desk. Further, a blade of such tape cutter has a toothed configuration which leaves a tooth mark at the cut end of the tape.

SUMMARY OF THE INVENTION

Accordingly, it is an object of the present invention to provide an easily assembled and disassembled device for cutting a tape from a roll of tape and opening an envelope.

Another object of the present invention is to provide a tape cutter which includes a push button having a cutting blade and a tape guide member supported on a tape supporter for easily and straightly cutting a tape from a roll of tape.

A further object of the present invention is to provide an envelope opener which includes a push button having a cutting blade and an envelope traveling member, whereby an envelope inserted into the envelope traveling member can be easily and straightly cut by the cutting blade of a push button.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an easily assembled and disassembled device for cutting a tape from a roll of tape and opening an envelope which includes a push button member having a cutting blade and a push button, a tape guiding member supported on an envelope inserting member and a roll tape supporting member assembled therewith and the push button member, whereby when the push button is downwardly pushed, the tape disposed on the tape guiding member or the envelope inserted into the envelope inserting member is easily and straightly cut by the cutting blade of the push button member.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
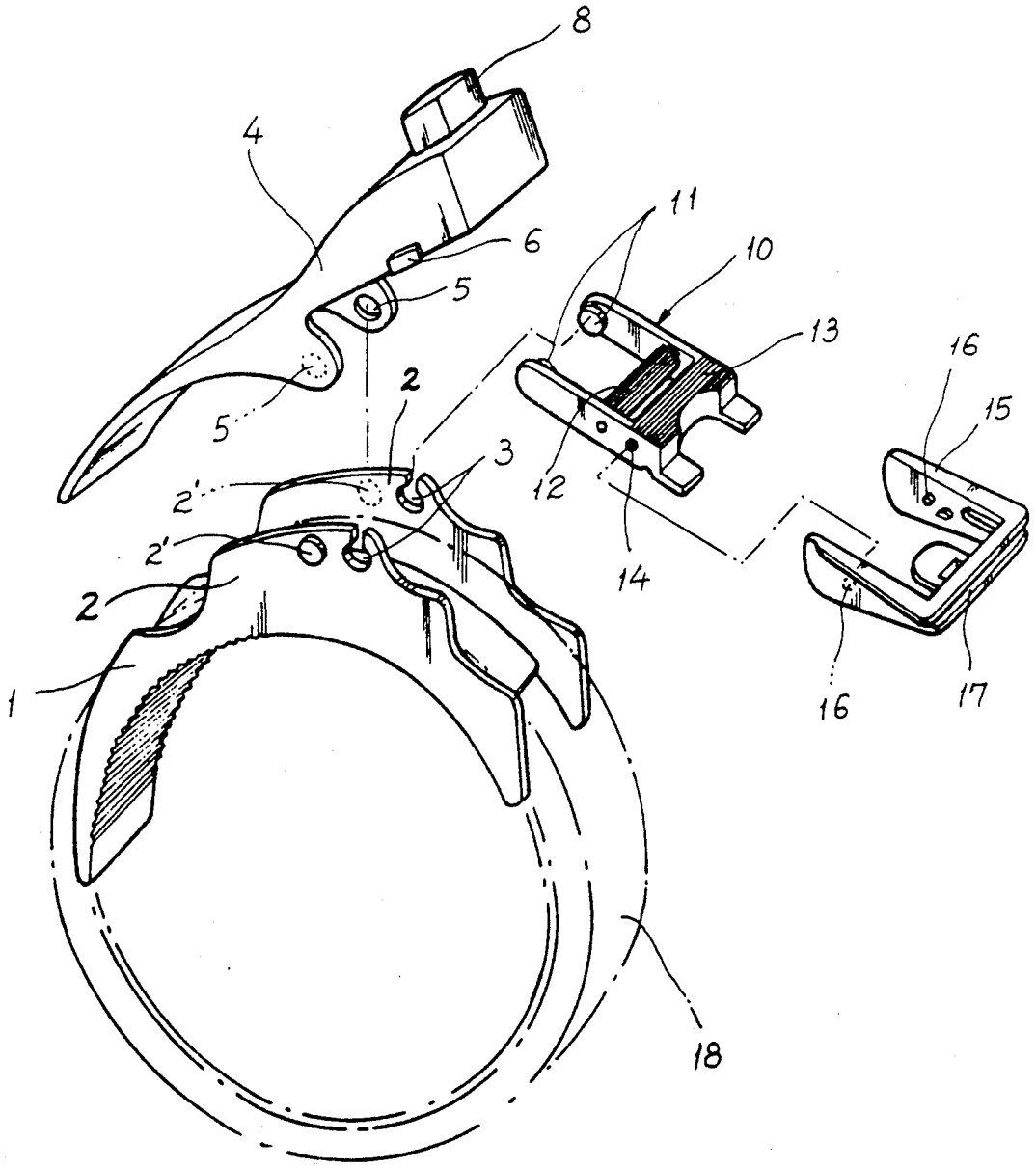
FIG. 1 is an exploded perspective view of the device for cutting a tape and opening an envelope according to the present invention.
Figure 2:
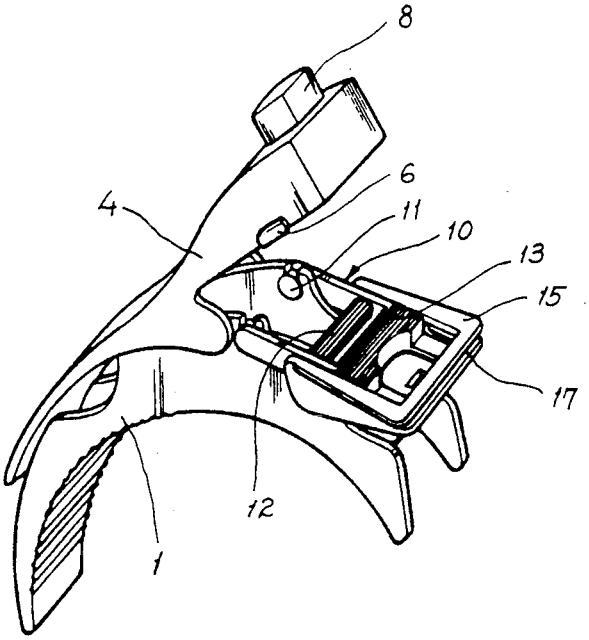
FIG. 2 is a perspective view of the device for cutting a tape and opening an envelope according to the present invention.
Figure 3:
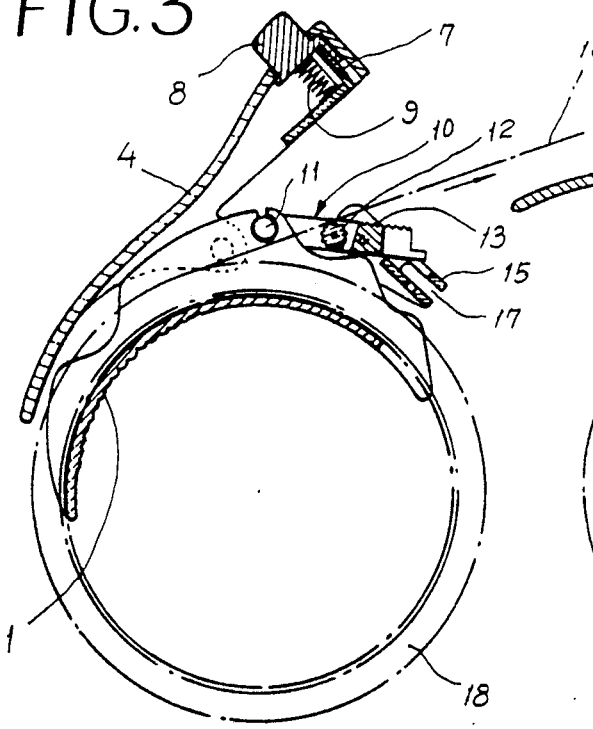
FIG. 3 is a sectional view of the device according to the present invention showing the device in an open position with a roll of tape.

Referring now in detail to the drawings for the purpose of illustrating preferred embodiments of the present invention, the device for cutting a tape and opening an envelope as shown in FIGS. 1, 2, and 3, comprises a tape roll supporter 1, a push button member 4, a tape guiding member 10, and an envelope inserting member 15.

The tape roll supporter 1 having an arch configuration for supporting the inside of a roll of tape 18 includes both side walls 2 having a outwardly raised portion 2' disposed on the upper portion of the outside of side walls 2, respectively, and a groove 3 disposed at the top portion of side walls 2, respectively.

The push button member 4 includes a push button 8 having a cutting blade 7 and a spring 9 (FIG. 3), and a pair of apertures 5 for engaging with the raised portions 2' of the tape roll supporter 1 while the push button member is assembled with the tape roll supporter 1. The push button member 4 further includes a pair of stoppers 6 disposed on both outer sides thereof for stopping on the envelope inserting member 15.

The tape guiding member 10 includes a pair of inwardly raised portions 11 for engaging with the pair of grooves 3, a roughing surface roller 12, a roughing surface contact member 13, and a pair of holes 14 disposed on the outside thereof. The roller 12 and contact 13 can guide the tape from the roll of tape 18 therethrough.

Figure 8:
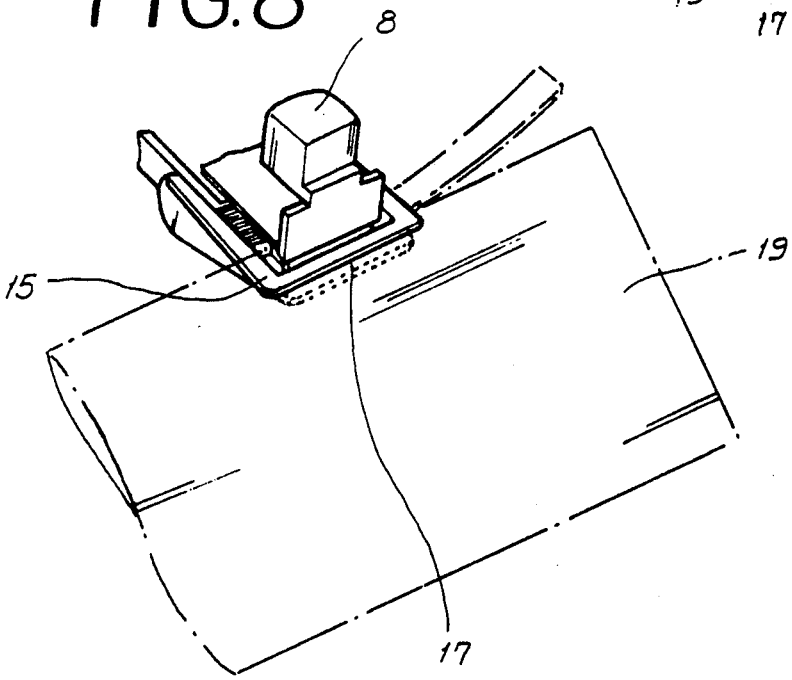
FIG. 8 is a perspective view of the device according to the present invention showing the device in a cutting position of an envelope.

The envelope inserting member 15 having a C-configuration includes an inward or inwardly mounted engagement 16 disposed on the inside thereof for pivotally engaging with the pair of holes 14 of the tape guiding member 10 for permitting an envelope to be cut to travel therethrough (FIG. 8).

The device according to the present invention operates as follows:

In assembly, first of all, a roll of tape 18 is put on the tape roll supporter 1, the tape guiding member 10 assembled with the envelope inserting member 15 through the holes 14 and the engagements 16 are assembled with the tape roll supporter 1 by engaging the inwardly raised portions 11 of the tape guiding member 10 with the grooves 3 of the tape roll supporter 1 as the push button member 4 is assembled with the tape roll supporter 1 by pivotally inserting the pair of outwardly raised portions 2' into the pair of apertures 5.

Figure 4:
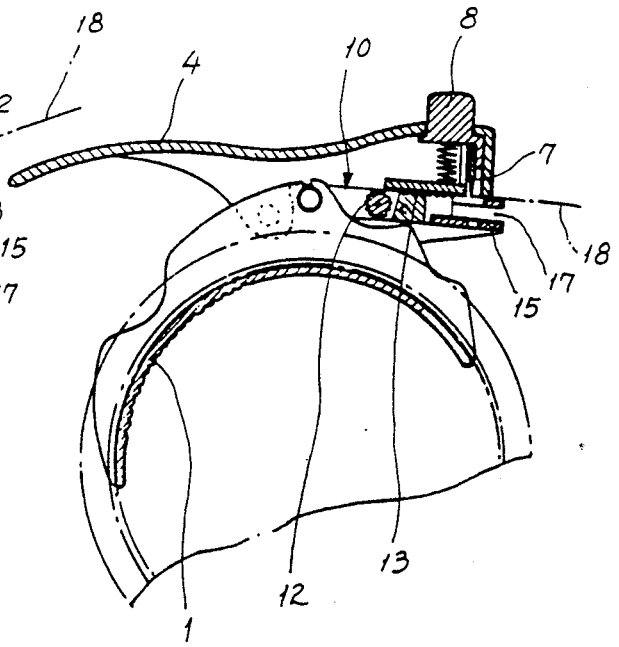
FIG. 4 is a sectional view of the device according to the present invention showing the device in a cutting position of a piece of tape from a roll.
Figure 5:
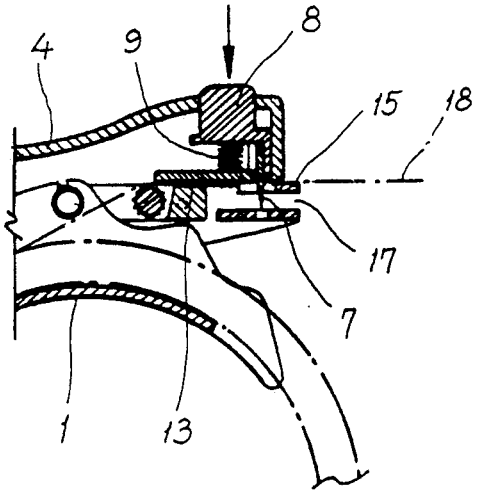
FIG. 5 is a sectional view of the device according to the present invention showing a basic construction of the device in a cutted position of a tape from a roll.
Figure 6:
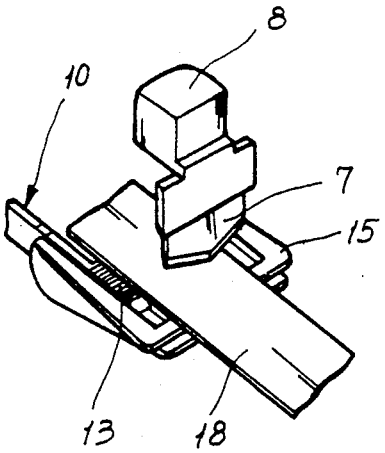
FIG. 6 is a perspective view of the device according to the present invention showing a basic construction of the device in a cutting position of a tape.
Figure 7:
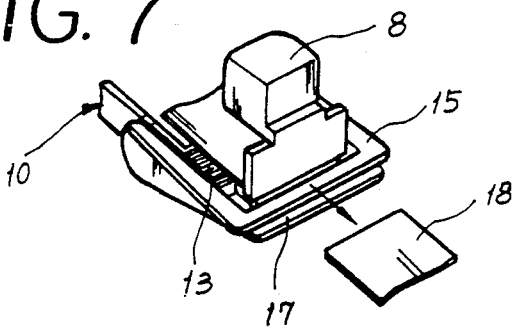
FIG. 7 is a perspective view of the device according to the present invention showing a basic construction of the device in a cutting position and a removal of the cutted tape.

Thereafter, the tape 18 from the roll of tape 18 is guided through the roughing surface roller 12 and roughing surface contact member 13 and pulled until a predetermined length of the tape 18 is obtained (FIG. 3). As shown in FIGS. 4, 5, and 6, when the push button 8 is pushed by the user, the tape 18 is cut and removed from the device (FIG. 7). The straight end of the cutting blade 7 results in a straight ended cut tape 18.

As shown in FIG. 8, when the user wants to open the envelope 19, the envelope 19 is inserted into the envelope inserting slot 17 and pulled for simultaneously opening the envelope 19 without any rough edges.

Accordingly, the device for cutting a tape and opening an envelope of the present invention is easily assembled and disassembled and has a double function for cutting tapes and opening envelopes. Also, the device of the present invention is simple to construction, inexpensive in manufacture, durable in use, and refined in appearance.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An easily assembled and disassembled device for cutting a tape from a roll of tape and opening an envelope, which comprises:

a tape roll supporter for supporting said roll of tape, said tape roll supporter including a pair of sidewalls having an outwardly raised portion disposed on the outside of both side walls and a groove disposed at the top of both side walls, a button member easily assembled with and disassembled from said tape roll supporter, a tape guiding member including a pair of inwardly raised portions, a roughing roller and a roughing surface for readily guiding said tape from the roll of tape, and a pair of holes, and an envelope inserting member easily assembled with and disassembled from said tape guiding member, said envelope inserting member including a pair of engagements for pivotally engaging with said pair of holes and an envelope travelling slot for inserting said envelope to be opened, whereby when the user pushes the push button, the tape put on the roller and roughing surface is easily cut and while the push button is being pushed, the inserted envelope in the envelope inserting slot is easily opened.

2. The assembled and disassembled device of claim 1, wherein said tape roll member has an arch configuration for agreeing with said roll of tape.

3. The assembled and disassembled device of claim 1, wherein said button member further includes a pair of stoppers extended from both sides thereof for stopping on said envelope inserting member so as to stop the cutting blade's downward movement.

* * * * *